United States Patent [19]

Senn

[11] Patent Number: 5,039,083

[45] Date of Patent: Aug. 13, 1991

[54] SHEET CONTROL APPARATUS AND METHOD FOR SHEET STACKER

[75] Inventor: Marvin J. Senn, Oconto Falls, Wis.

[73] Assignee: John Brown Development, Inc., Oconto Falls, Wis.

[21] Appl. No.: 461,243

[22] Filed: Jan. 5, 1990

[51] Int. Cl.[5] ..... B65H 29/68

[52] U.S. Cl. ..... 271/182; 271/198; 271/213; 414/790.8

[58] Field of Search ..... 271/182, 183, 198, 202, 271/203, 213, 216–218, 258; 414/790.8

[56] References Cited

U.S. PATENT DOCUMENTS

| | | | |
|---|---|---|---|
| 3,006,258 | 10/1961 | Jochem | 414/790.8 |
| 3,507,489 | 4/1970 | Wilshin et al. | 271/46 |
| 3,905,487 | 9/1975 | Hoke et al. | 214/6 |
| 3,998,141 | 12/1976 | Hsiue | 93/93 |
| 4,073,223 | 2/1978 | Crawford | 93/93 |
| 4,133,523 | 1/1979 | Berthelot | 271/182 |
| 4,241,909 | 12/1980 | Murphy et al. | 271/182 |
| 4,265,443 | 5/1981 | Berthelot | 271/182 |
| 4,367,997 | 1/1983 | Schweingruber | 414/38 |
| 4,424,966 | 1/1984 | Chandhoke | 271/182 |
| 4,541,763 | 9/1985 | Chandhoke et al. | 271/218 |
| 4,667,953 | 5/1987 | Hirakawa et al. | 271/182 |
| 4,669,720 | 6/1987 | Rosati | 271/256 |
| 4,712,787 | 12/1987 | Princiotta et al. | 271/182 |
| 4,750,732 | 6/1988 | Hara et al. | 271/258 |
| 4,934,687 | 6/1990 | Hayden et al. | 271/202 |

*Primary Examiner*—Joseph E. Valenza
*Assistant Examiner*—Steve Reiss
*Attorney, Agent, or Firm*—Andrus, Sceales, Starke & Sawall

[57] ABSTRACT

A sheet stacker includes a belt conveyor having shingled sheets which includes aligned crowned belt pulleys rotating endless belts. A vertically movable table is located such that the conveyor propels the sheets falling downwardly to form a pile of sheets thereon. A fork unit moves inwardly across the stacker as a temporary support during pile removal. A brake and clutch unit is connected to the pulleys. A sheet control includes pivoted fingers aligned with the belts and secured to a shaft. An actuating arm pivots the shaft to move the fingers into engagement with said aligned belts on the downstream side of the pulleys. A pneumatic control provides a conjoint control to actuate said brake and pivot the finger shaft for momentarily stopping sheet movement in synchronism with the actuation of the fork.

26 Claims, 3 Drawing Sheets

FIG. 1
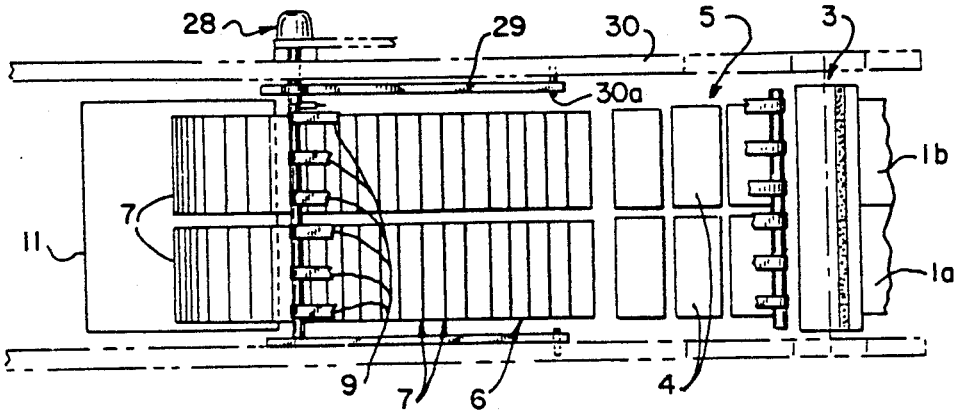
FIG. 2
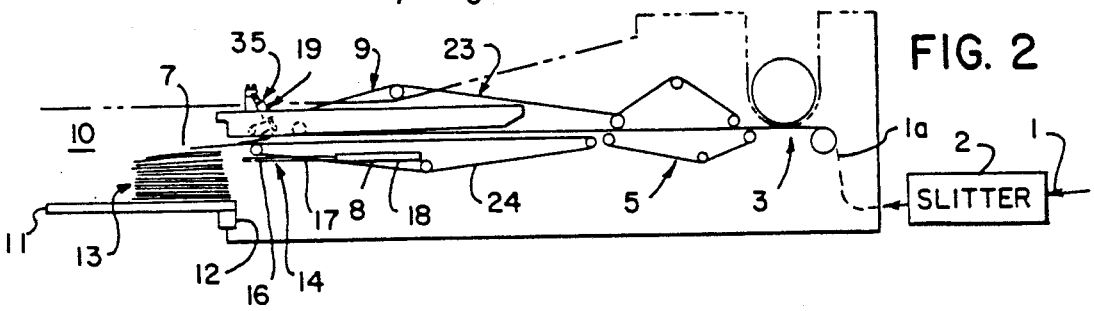
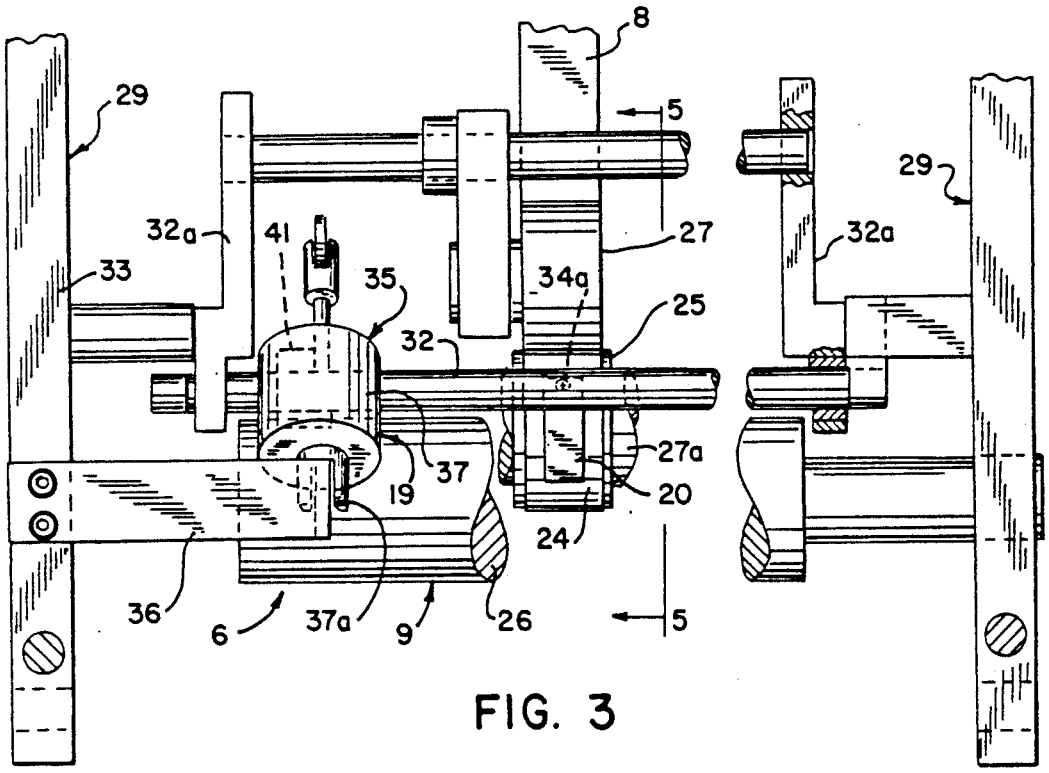
FIG. 3

FIG. 4
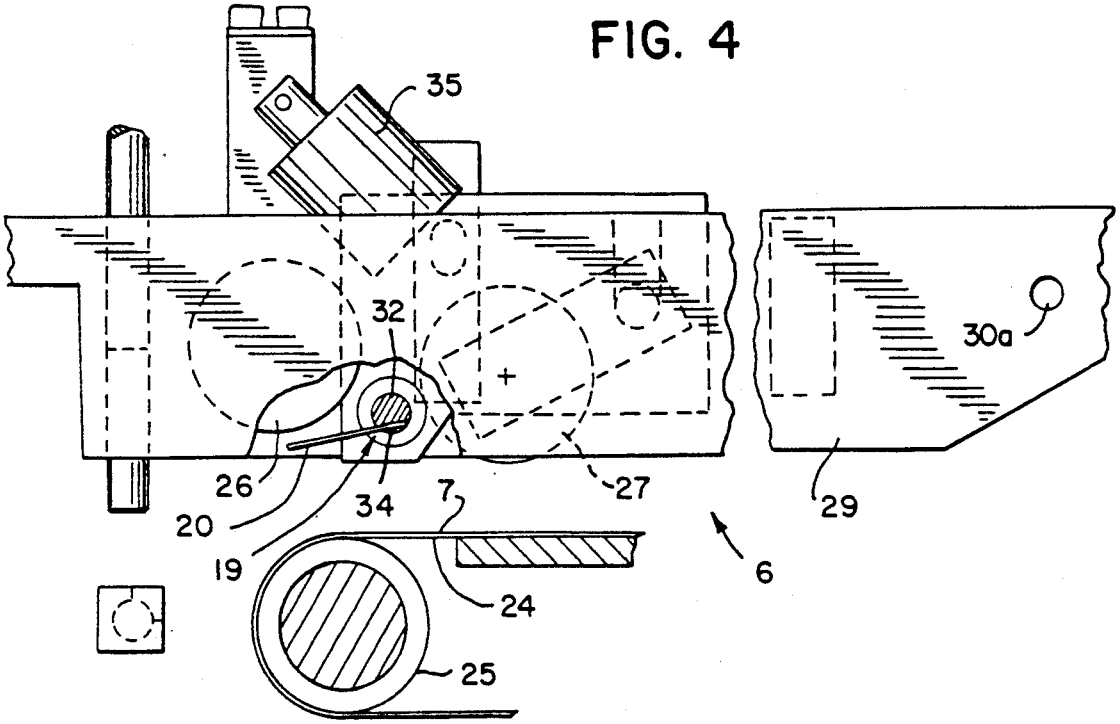
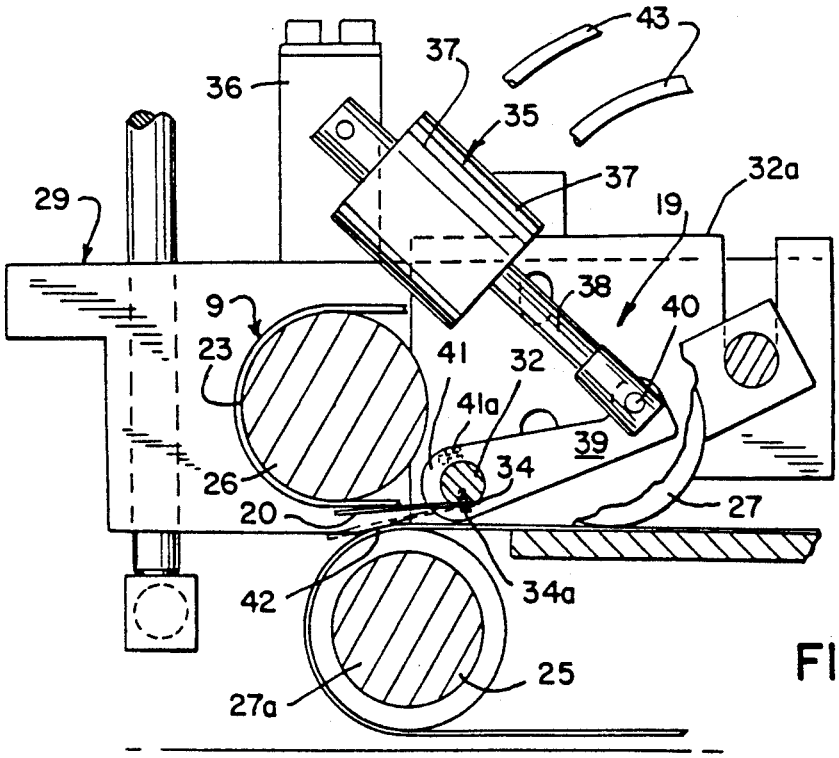
FIG. 5

SHEET CONTROL APPARATUS AND METHOD FOR SHEET STACKER

BACKGROUND OF THE PRESENT INVENTION

This invention relates to a sheet control apparatus and method for sheet-fed stackers and particularly to a sheet retard apparatus and method to positively control the first sheet in a stack to permit movement of a stacker support into stacking position.

In the processing of flexible sheet members formed of paper, film or the like, a continuous series of sheets are formed and fed through a processing line. The individual sheets are often assembled at the end of the line in a vertical stack of a predetermined number of sheets. In a well known process, the successive sheets are discharged into a vertical stacker with each sheet dropping on top of the preceeding sheet in the stack. After a predetermined number of sheets are placed in the stack, the stack of sheets is removed and a new stack is initiated. To permit continuous flow of the sheets and thereby of the processing line, a mechanism must be provided to temporarily support the first sheet in the next stack, or sheets must be diverted into alternate sheet receiving devices. In systems using an in-line receiving device, a temporary support is interposed between the last sheet in a formed stack and the first sheet of the new stack to permit continuous flow of the sheets. The temporary support is advantageously a multiple fork member. The sheets are fed onto the temporary stack support while the formed stack is removed. After removal of the form stacked, the main support structure is returned to its supporting position and in so moving picks up the sheets from the temporary support, which is removed to allow the accumulated sheets to move into the main stacker. The new stack then continues to build until a full stack is established and the system recycles. With high speed processing, the individual sheets are normally formed in a shingled or overlapping manner to create proper timing of the several upstream machines acting to form the final sheets and the stacking machine or apparatus. With high speed systems, the first sheet in a stack tends to move into the stacking receiver with its leading edge dropping into the position of the incoming temporary support. The temporary support is moved as rapidly as possible and thus is moving at a relatively high speed. The leading end of the temporary support such as fork members often engage the first sheet with a possible disruption and damage of the first sheet or sheets. Engagement with the sheet can create for example wrinkles or folds of the sheet tending to interfere with the appropriate formation of a neat and acceptable stack of sheets. This then results at best in a lost or improper product in the stack.

SUMMARY OF THE INVENTION

The present invention is directed to a down stacker apparatus for stacking a plurality of flexible sheets including a transfer control apparatus which establishes reliable formation of a succeeding stack during removal of an immediately preceeding stack. Generally, in accordance with the present invention, a retard unit momentarily engages at least the first sheet in each succeeding stack and establishes a period for introducing a support for the succeeding stack. More particularly in one embodiment, a temporary support is mounted for laterally reciprocating movement into the vertical stacking path. A retard unit engages a sheet moving into the stacker apparatus and momentarily retards the sheet movement. The retard unit is operative momentarily and for a sufficient period to insure that the leading edge portion of the initial sheet in a stack does not move into damaging overlying relationship to the incoming edge of the support.

In a particularly practical embodiment wherein shingled sheets are supported for horizontal movement on a conventional belt conveyor using laterally spaced tapes or belts, a plurality of flexible fingers are located in aligned relation with the laterally spaced belts. The fingers are secured to a pivot support rotatably mounted to the machine frame structure. The fingers are preferably mounted for adjustable angular position with the fingers projecting downwardly and upstream of the sheet movement. A motor unit is connected to the support and actuated in sychronism with the temporary support to pivot the fingers and move the outer ends of the fingers into engagement with the aligned sheet and belt unit. The fingers preferably engage a trailing portion of the aligned sheet which projects downstream into the downstacker. In a preferred construction, the conveyor includes end pulleys at the discharge end for the belts. The pulleys are crowned and are mounted to a common drive shaft. A drive unit is coupled by a clutch and brake unit to the drive shaft. The clutch and brake unit is actuated to momentarily brake the pulleys as the fingers are applied to the sheets. The combination of the braked conveyor and the fingers clamping the sheet to the belt or tap: can establish a momentary stoppage of the sheet into the stacker to allow proper movement of the initial sheet into the stacker.

The fingers may advantageously be formed as a thin strip-like member of a spring steel. Each finger is aligned with a conveyor tape which is wrapped about a crowned pulley. The pivot support is reliably and positively moved between a release position and a sheet clamp position by an air cylinder connected by a pivot arm to the finger shaft.

DESCRIPTION OF THE DRAWINGS

The drawings furnished herewith illustrate a best mode presently contemplated for carrying out the invention and are described hereinafter.

In the drawings:

FIG. 1 is a diagrammatic plan view of a sheet forming and stacking apparatus;

FIG. 2 is a side elevational view of FIG. 1;

FIG. 3 is an enlarged fragmentary plan view of a sheet control unit shown in FIGS. 1 and 2 and illustrating one embodiment of the invention;

FIG. 4 is a fragmentary side view of FIG. 3 with parts broken away and sectioned to show detail of contruction;

FIG. 5 is a sectional view taken generally on line 5—5 of FIG. 3;

DESCRIPTION OF THE ILLUSTRATED EMBODIMENT

Figure 7:
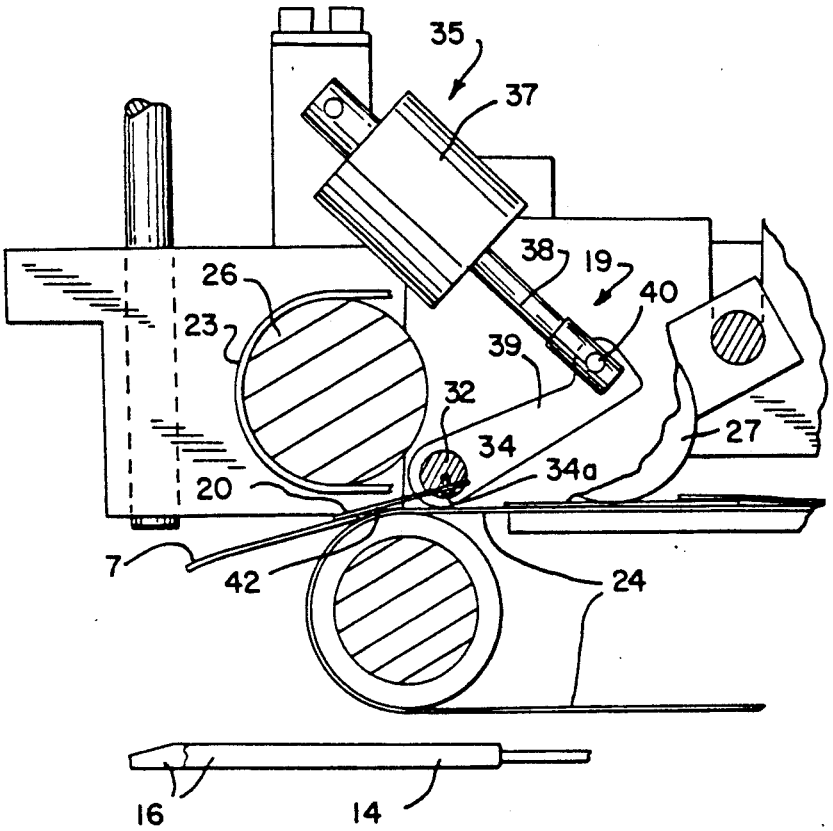
FIGS. 7 is a view similar to FIG. 5 of the coupling between the conveyor and the stacker and illustrating the holding position of the illustrated embodiment.

Referring to the drawings and particularly to FIGS. 1 and 2, a sheet forming and stacking apparatus for processing a web 1 of paper or the like includes a slitter 2 for longitudinally severing the web 1 into parallel webs 1*a* and 1*b* and a sheeter unit 3 for severing the webs into individual sheets 4 moving as a continuous stream to a fast tape transfer conveyor 5. A shingling unit 6 receives the sheets 4 and establishes a significant overlap of the sheets 4 to form a flow of overlapped or shingled sheets 7 in accordance with known processing. The shingling unit 6 includes a bottom slow tape or belt conveyor 8 and a top fast belt conveyor 9 for controlled transfer of the shingled sheets 7, and sequential transfer of the individual sheets 7 into a vertical stacker unit 10. The sheets 7 are propelled from the end of the slow tape conveyor 8 and dropped by gravity onto a vertically movable plate unit 11 of stacker unit 10. Plate unit 11 is vertically movable through a suitable motor unit 12, such as a D.C. motor and acme screw, pneumatic cylinder unit or other suitable devices for dropping the same for removable of a sheet pile or stack 13 in unit 10. To maintain a continous processing line, a temporary horizontal support unit 14 is mounted for movement over the receiver during the stack removal and temporarily stores the first sheets 7 in the next stack 15, as shown in FIG. 7. The illustrated support unit 14 is a fork device including a plurality of generally spaced fork fingers 16 connected at one end to a cross member 17. A pneumatic cylinder unit 18 is coupled to member 17 for selective positioning between the retracted position and an extended support position shown in FIGS. 5 and 7.

In accordance with the teaching of this invention, a sheet retard or stop unit 19 is mounted to the downstream end of the batch conveyor unit 6. The illustrated stop unit 19 includes fingers 20 which are normally spaced from the slow tape conveyor 8 and the sheets 7 moving into the stacker unit 10. The stop unit 19 is actuated in synchronism with the movement of the fork support 14 into position for initiation of a new sheet stack 15. The stop unit 19 momentarily holds the first sheet 7 of the new sheet stack 15 to permit movement of support 14 into position without adverse engagement with the first sheet 7 of the new stack 15. With high speed feeding of the shingled sheets 7, the final sheet 7, at the instance of transfer, is dropping into the receiver with the leading portion 21 of the following initial sheet 7 of the next stack 15 also falling into the receiver unit. The leading portion 21 is subject to interception by the leading end of forks 16, as shown in phantom FIG. 7. The initial sheet or sheets 7 of the new stack 15 may be damaged, an erroneous number of sheets 7 fed into the stacks or the like if the interception is permitted. The stop unit 19 functions to momentarily interrupt the flow of sheets 7 at the proper moment to prevent the flow of the initial sheet 7 into the path of support 14 and forks 16. The sheet 7 is then released to maintain essentially a continous flow of the sheets 4 and 7, and without interruption of the operation of the upstream web processing apparatus.

The present invention is particularly directed to the provision of an appropriate stop unit 19. The other apparatus and components may be of any suitable construction and the illustrated structures are only described as necessary to fully understand the illustrated embodiment.

More particularly and referring to FIGS. 3–5, the conveyor unit 6 is a tape conveyor structure. The top and the lower conveyors 9 and 8 respectively include a plurality of laterally spaced and endless tapes or belts 23 and 24, respectively. The top conveyor tapes 23 are fast speed tapes while the lower belt 24 are slow speed tapes. The lower conveyor unit 8 includes driven crowned pulleys 25 at the discharge end of the conveyor belts 24. A guide pulley 26 of the top conveyor is located slightly downstream of the crowned pulley 25 and a hold-down pulley 27 is located slightly upstream of pulleys 25 and holds the sheets 7 in pressure engagement with the bottom belts 24. The crowned pulley 25 are secured to a driven shaft 27*a* which is coupled by a brake and clutch unit 28 (shown in FIG. 1) to the main line drive, not shown, to selectively drive and stop the pulley 25, and thereby the slow tape belts 24. The top conveyor 9 includes a U-shaped frame unit 29 pivoted to the main frame 30 as at 30*a*. The tape pulley 26 is secured to the outer end of the frame 30 and supports the endless top belts 23 in alignment with the belts 24 of the lower conveyor 8. Frame 30 may be raised relative to conveyor 8 as shown in FIG. 4.

The hold down unit 19 is secured to the U-shaped frame unit 29 with the fingers 20 properly located beneath the tape roller unit 26 and immediately above the slow tapes or belts 24 and the crowned pulleys 25.

Referring particularly to FIGS. 3–5, a finger shaft 32 is pivotally mounted at the opposite ends to the opposite frame plates 33 of the frame unit 29. Finger shaft 32 and a shaft for the holding down rollers 27 are mounted to bracket 32*a* which is secured to the inside of frames 33. Each finger 20 is similarly secured to a flat 34 on the shaft 32 by a screw 34*a*, and projects downwardly and downstream of shaft 32. The finger 20 is shown as a flat strip-like member of a flexible material, such as a suitable spring steel, abutting the flat 34. The finger 20 is aligned over the crowned pulley 25 and thus engages the sheet 7 in alignment with the raised portion of the crowned pulley 25. An air cylinder unit 35 is mounted to the one frame plate 33 of unit 29 by a bracket 36. The cylinder assembly 35 includes a cylinder 37 pivotally attached by a pivot unit 37*a* to bracket 36 and projecting upstream of the conveyor unit 6. A piston rod 38 extends upstream of the finger shaft 32. A pivot arm 39 is connected to the outer end of rod 38 by a suitable pin unit 40. The arm 39 extends downstream to the shaft 32 and is adjustably secured thereto by an integral L-shaped collar 41 which encircles the shaft and has a clamping bolt 41*a* for releasably collapsing the collar onto the shaft.

With the piston rod 38 extended, the fingers 20 are located in upwardly spaced relation to the sheet path at the discharge end of the conveyor unit 8, as shown in FIG. 5.

Retraction of piston rod 38 pivots shaft 32 counterclockwise as shown in FIGS. 4 and 5 and rotates the fingers 20. The outer end portions of fingers 20 are rotated into tangential engagment with the crowned pulleys 25 to the downstream side of the uppermost roller surface, as shown in phantom in FIG. 5 and in FIG. 7 at 42.

Figure 6:
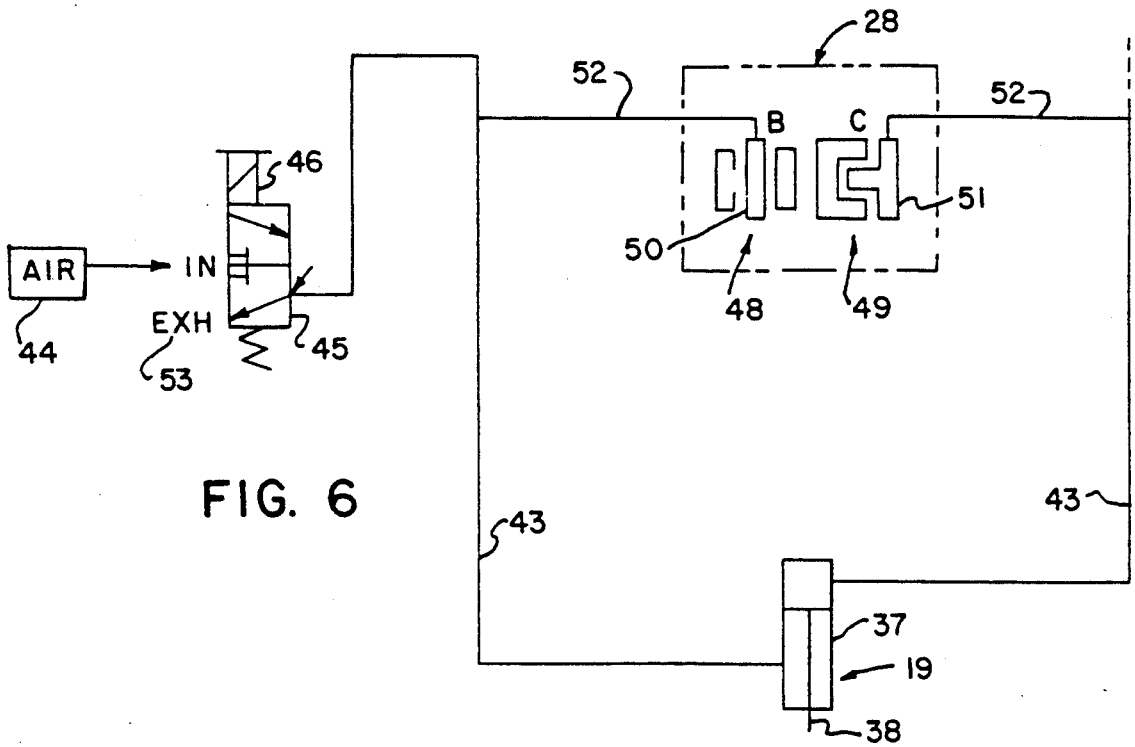
FIG. 6 is a schematic of a pneumatic control for the sheet control system shown in FIGS. 1–5.

The finger air cylinder unit 37 includes a pair of lines 43 connected, as shown in FIG. 6, to an air source 44 by a switching valve 45 for connecting the opposite ends alternatively to positive air pressure and to return for selectively extending and retracting the piston rod 38. The air valve 45 includes a powered control unit 46, such as a solenoid, to selectively alternate the air pressure connection and thereby the finger positions. Generally, the control unit 46 actuates the clutch and brake unit 28 for the crowned pulley 25 and the finger cylinder 37 in time relation and to the actuation of the temporary support unit 14 to establish a desired control of the movement and placement of the first sheet 7 in the next succeeding stack 15 in stacker 10.

Referring particularly to FIG. 6, a schematic illustration of the pneumatic control as applied to the brake/-clutch unit 28 and the finger control cylinder 37 is diagrammatically illustrated. The brake/clutch unit 28 is diagrammatically illustrated including a friction brake 48 and a friction clutch 49. The friction brake 48 includes a pneumatically positioned brake operating element 50. When positive pressure is applied to the brake element 50, the brake 48 is set and provides a rapid stopping of the pulleys 25. The friction clutch 49 is provided with a pneumatically positioned clutch operating element 51, and when set, couple the pulleys 25 to the driven shaft to rapidly accelerate and drive the pulleys 25 and the interconnected belts 24. Fluid lines 52 are connected respectively to the brake operator element 50 and pneumatic clutch operator element 51. The cylinder unit 37 has its lines 43 connected in parallel with the lines 52 connected to the element 50 and the element 51 respectively.

The control valve 45 is coupled to the positive supply 44 and to the common line to the brake operator and the retraction line of the finger cylinder 37. When positive pressure is applied via the valve 45, the brake 48 is set and the cylinder 37 is actuated to retract piston rod 38 and move the fingers 20 into holding engagement with the sheet 7 against the tapes 24 and pulleys 25. Conversely, when the valve 45 is de-energized or reset, it connects exhaust 53 to the brake 48 and to the cylinder 37 thereby extending the cylinder unit to release the sheet 7 from fingers 20 and simultaneously releases the brake 48 and sets clutch 49 to re-establish the drive through the energized brake/clutch unit 28.

In summary, when the web processing line is operating and the batcher and conveyor 8 is running, the sheet holder or retard unit 19 is operated in conjunction with the slow tapes 24 of the conveyor 8. Under normal operation during the forming of a stack 13 in the stacker 10, the sheet retard cylinder 37 is actuated to retract the fingers 20 from the path of sheets 7 and tapes 24, and the clutch 49 is simultaneously energized with the brake 48 de-energized, to provide for the continuous transfer of the sheets 7 from conveyor 8 and the piling of the sheets 7 into and on the table 11 of the stacker 10. After a predetermined number of sheets 7 have been placed onto the table 11, the table 11 is dropped and the temporary support 14 shoots outwardly into overlying relation to the preset batch of sheets in stack 13. The support 14 is thus in position to support the next incoming sheets 7 until the sheet pile 13 is removed as by a pusher or the like, not shown, and returns to a raised support position. In returning upwardly, the slotted table moves upwardly through the forks of support 14, picks-up the accumulated sheets 7 in stack 15 and the support 14 is retracted. The sheets 7 again continue to pile onto the table 11, which moves downwardly to form another complete stack, whereupon the above cycle is repeated.

Referring particularly to the diagrammatic illustration FIG. 7, simultaneously with the shooting out of the forked support 14 or other temporary support, the brake unit 48 is energized to essentially stop the sheet conveyor's tapes or belts 24 and the sheet stop or retard unit 19 is actuated to pivot the shaft and rotate the fingers 20 downwardly, with the outer ends engaging and forcing the sheet 7 against the slow tapes 24 for a momentary period. During this period, the outer ends of the forks 16 or such other support structure provided, move outwardly to the point where the held sheet 7 can be released and move into the stacker 10 without damaging engagement with the forks 16. The sequence of actuating the several elements for momentary stopping sheets 7 is readily operated almost instantaneously, and within milliseconds, including the momentary holding or retarding of the sheet movement. The brake 48 may be first set followed by immediate actuation of the fingers, which then engage the sheet 7 in alignment with the belts 24 without any significant movement of the sheet 7 between fingers 20 and pulleys 25. The fingers 20 and brake 48 may be operated together or even in reverse sequence within the broadest aspects of this invention.

The system is readily adapted as a retrofit kit for application to various existing batching and stacking devices. Generally, existing devices include a clutch for driving of the batcher pulleys in a continuous uninterrupted manner with the line. The existing clutch can be readily replaced with a conventional clutch/brake unit and with an appropriate pneumatic control system, such as shown in FIG. 6.

The illustrated embodiment of the invention includes readily available and fabricated parts and components which can be conveniently and readily assembled with existing machines as well as newly fabricated machines.

Although shown in the preferred embodiment with the special braking of the belt conveyor and the holding fingers aligned with and engaging the several belts, other systems can be readily provided to momentarily retard including full stopping of the initial sheet or sheets of a stack within the teaching of the present invention. For example, vacuum operable means may be coupled to the sheet or sheets to retard movement with or without conjoint control of the sheet conveyor. Partial path change means may be provided to retard the movement into the stacker. These and other systems can be provided in applying the present teaching to the particularly sheet processing line for stacking of the processed sheets.

Various modes of carrying out the invention are contemplated as being within the scope of the following claims particularly pointing out and distinctly claiming the subject matter which is regarded as the invention.

I claim:

1. A sheet processing apparatus including a vertical stacker for receiving successive sheets and having a support member interposed above a completed sheet stack to initiate a new stack, comprising a conveyor mounted immediately upstream of said stacker for carrying sequential sheets and discharging said sequential sheets into said stacker, a sheet control unit coupled to said conveyor and operable to engage an initial sheet to be discharged as the initial sheet of a stack and to momentarily retard the movement of said initial sheet into said stacker during the selected movement of the support member into said stacker.

2. The apparatus of claim 1, wherein said conveyor includes horizontal endless belts laterally spaced and defining a planar support for said sheets, said belts having common aligned discharge ends with said sheets being propelled from the discharge ends with the leading portion of each sheet dropping downwardly and forwardly into the stacker, said sheet control unit including sheet retard elements mounted above the discharge ends of said belts and vertically movable toward and from engagement with the sheets passing over said discharge ends to establish said momentary retard of the sheet.

3. The apparatus of claim 2, including a driven shaft unit, a plurality of spaced drive pulleys on said shaft unit, said belts being wound around said pulleys, and brake means to selectively brake said pulleys and reduce the movement of said belts, and operating means coupled to said brake means to actuate said brake means in timed relation to the actuation of said sheet retard elements.

4. The apparatus of claim 3, including a clutch unit coupled to said driven shaft unit and having a powered input for rotating said shaft unit, and said operating means being operable to open said clutch unit in synchronism with actuating said brake means.

5. The apparatus of claim 1, wherein said sheets are shingled, said conveyor including a plurality of laterally spaced endless belts wound about horizontally spaced pulleys and having a top horizontal transfer run for supporting a plurality of shingled sheets, and a bottom return run, said conveyor operating at a sufficient speed to propel each bottom sheet from the upstream end of the conveyor belts, said stacker being located immediately adjacent the discharge end of said conveyor belts and including a vertically movable table located to receive said sheets in succession and thereby establishing a pile of said sheets, said support member being a temporary planar structure mounted adjacent the upper end of said stacker for movement into overlying relationship to said table and a pile of sheets on said table to provide a temporary support for initiating a new pile of sheets.

6. The apparatus of claim 5, wherein said sheet control unit including a first unit coupled to control the speed of said shingling conveyor and a second unit adapted to engage a sheet at the discharge end of said conveyor to momentarily restrict the movement of the sheet from the discharge end of the conveyor.

7. A sheet processing apparatus including a vertical stacker for receiving successive sheets and having a support member interposed above a completed sheet stack to initiate a new stack, comprising a conveyor mounted immediately upstream of said stacker for carrying sequential sheets and propelling said sequential sheets from the conveyor into said stacker, and a sheet control unit coupled to said conveyor and including a member selectively positioned to engage an initial sheet to be discharged as the initial sheet of a stack during movement of the support member into said stacker.

8. A batching unit for successive piling of sheets into piles of a predetermined number of sheets, comprising a batch conveyor having sheets continuously placed onto said conveyor with following sheets in overlapping relation to the preceding sheet to define shingled sheets, said conveyor including laterally spaced belts defining a planar transfer surface for said shingled sheets, the discharge end of said conveyor including a plurality of crowned pulleys aligned one each with each of said belts and constituting a drive force for rotating of said endless belts, a stacker downstream of said crowned pulleys and including a vertically movable table, said sheets moving from said discharge end of said conveyor onto said table and falling downwardly under essentially gravity forces with succeeding sheets piled on top of the preceeding sheets to form a pile of said sheets, a fork unit having a plurality of supporting tines extending outwardly from a common support, said fork unit being reciprocately mounted adjacent said stacker, a motor unit operable to move said fork unit inwardly across the stacker to form a temporary support for receiving of said sheets, and a sheet control unit coupled to said conveyor and operable to engage a sheet moving from said conveyor to momentarily reduce the movement of said engaged sheet, and means to actuate said sheet control unit in timed relation to the movement of said fork unit to prevent movement of said sheet in the path of said fork unit.

9. The apparatus of claim 8, including a pulley shaft, said pulleys being mounted on said shaft and rotating therewith, a driven shaft, and said control unit including a brake unit and a clutch unit serially connected with said brake unit between said pulley shaft and said driven shaft and operable to drive said pulley shaft with said clutch unit energized and to stop said pulley shaft with said brake unit energized.

10. The apparatus of claim 9, including a power unit operable to extend and retract said fork, said control unit including a pivot shaft mounted above and in spanning relation to said belts, fingers secured to said pivot shaft in laterally spaced relation and in alignment with said belts, a power unit having an actuating arm connected to said shaft for pivoting of said shaft between a first position with said fingers spaced upwardly of said belts and a second position with said shaft pivoted to move the outer ends of said fingers into engagement with said aligned belts.

11. The apparatus of claim 10, wherein said fingers project downstream from said shaft with the outer ends of said fingers overlying said pulleys for selective movement into engagement with said belts on the downstream side of said pulleys.

12. The apparatus of claim 10, including a pneumatic control means including a pressure source and a control valve having a positive output connected to said brake and to said power unit to actuate said brake and said stop cylinder to brake said pulleys and thereby said belts and to move said fingers into forcing engagement with said sheet to force the sheet onto the aligned belt and pulley for momentarily stopping movement of the sheet, and control means for actuating of said control valve in synchronism with the actuation of said fork to control said sheet during the movement of said fork into said stacker.

13. A sheet batching apparatus, comprising a conveyor including a plurality of laterally spaced endless belts having a horizontal transfer run for supporting a plurality of sheets, drive means connected to said conveyor for operating said conveyor at a sufficient speed to propel each bottom sheet from the upstream end of the conveyor belts, a sheet stacker located immediately adjacent the discharge end of said conveyor belts and including a vertically movable table located to receive said sheets in succession and thereby establishing a pile of said sheets, a temporary planar support unit mounted adjacent the upper end of said stacker for movement into overlying relationship to said table and a pile of sheets in said stacker to provide a temporary support for initiating a stack, and sheet control unit adapted to clamp a sheet against said conveyor and to remove the drive means from said conveyor substantially at the same time to momentarily restrict movement of the sheet from the end of the batch conveyor and thereby establish movement of the planar support unit to supporting engagement prior to movement of the leading end of the first sheet in the pile into the path of the support unit.

14. The apparatus of claim 13, wherein a clutch and brake unit connects said conveyor to said drive means, and said control unit opens said clutch and sets said brake with the clamping of the sheet to the conveyor.

15. The apparatus of claim 14, wherein said sheet control unit includes a pivotally mounted shaft mounted above and in spanning relation to said belts, fingers having generally flat outer sheet engaging portions and secured to said shaft in laterally spaced relation and in alignment with said belts, and a positioning unit secured to said conveyor and having an actuating member connected to said shaft for pivoting of said shaft between a first position with said fingers spaced upwardly of said belts and a second position with said shaft pivoted to move the outer sheet engaging portions of said fingers into engagement with said aligned belts.

16. The apparatus of claim 15, wherein said shaft includes a chordal flat aligned with and opposed to said belts, and means securing said fingers to said flats.

17. The apparatus of claim 15, wherein said fingers project downstream from said shaft with the outer ends of said fingers overlying the outer end portion of said belts for selective movement into engagement with said belts on the downstream side of said belts.

18. The apparatus of claim 15, wherein said positioning unit includes a pneumatic cylinder unit having a pivot arm coupled to said shaft.

19. The apparatus of claim 15, having a stop unit coupled to control the speed of said conveyor.

20. A stacking apparatus for successive piling of sheets into piles of a predetermined number of sheets, comprising a batch conveyor having sheets continuously fed onto said conveyor with following sheets in overlapping relation to the preceeding sheets, said conveyor including laterally spaced endless belts defining a planar transfer surface for said sheets, the discharged end of said conveyor including a plurality of crowned pulleys aligned one each with each of said endless belts and constituting a drive force for rotating of said endless belts, a stacker downstream of said crowned pulleys and including a vertically movable table, said sheets being propelled from said discharge end of said conveyor onto said table and falling downwardly under essentially gravity forces with succeeding sheets piled precisely on top of the preceeding sheets to form a pile of said sheets, a fork unit having a plurality of supporting tines extending outwardly from a common support, said fork being reciprocately mounted adjacent said stacker, a cylinder unit operable to move said fork inwardly across the stacker to form a temporary support for receiving of said sheets and to retract said fork, a driven shaft, a brake unit, a clutch unit serially connected with said brake unit between said pulleys and said driven shaft and operable to drive said pulleys with said clutch unit energized and to stop said pulleys with said brake energized, a cylinder unit operable to extend and retract said fork, a sheet control unit including a pivotally mounted shaft mounted above and in spanning relation to said belts, said shaft having a chordal flat aligned with and opposed to said belts, fingers secured to said flat in laterally spaced relation and in alignment with said belts, a pneumatic cylinder unit secured to said conveyor and having an actuating arm connected to said shaft for pivoting of said shaft between a first position with said fingers spaced upwardly of said belts and a second position with said shaft pivoted to move the outer ends of said fingers into engagement with said aligned belts, said fingers projecting downstream from said shaft with the outer ends of said fingers overlying said pulleys for selective movement into engagement with said belts on the downstream side of said pulleys, and a pneumatic control means including a pressure source and a control valve having a positive output connected to said brake and to said stop cylinder to actuate said brake and said stop cylinder to stop said pulleys and thereby said belts and to move said fingers into forcing engagement with said sheet to force the sheet onto the belt and pulley for momentarily stopping movement of the sheet, and control means for actuating of said control valve in timed relation with the actuation of the extension fork cylinder unit to control said sheet during movement of said fork into said stacker and thereby prevent interengagement of the leading edge of the fork with the first sheet received from said conveyor.

21. The method of stacking a horizontal stream of sheets into a series of stacks, comprising propelling said sheets into a stacker with the sheets dropping by gravity onto a vertically moving support, moving a temporary support above a completed stack in said stacker, and momentarily engaging the sheet to be propelled into said stacker as the first sheet on said temporary support to permit location of said support without adverse engagement with said sheet.

22. The method of claim 21, including momentarily removing the propelling force from said first sheet.

23. The method of claim 22, wherein said engaging step includes firmly clamping said first sheet to a support to essentially stop said first sheet.

24. The method of controlling the feeding of sheets from a conveyor into a stacking unit and separating of a newly forming stack from a previously formed stack in said stacking unit by insertion of a separating unit between said stacks, said conveyor having a discharge end propelling each sheet into said stacking unit, comprising the steps of momentarily engaging a sheet for a momentary period to retard the movement of the sheet from said conveyor, simultaneously removing the driving force from said conveyor for essentially the same period, and during said momentary period inserting said separating unit into said stacking unit to separate succeeding stacks.

25. The method of claim 24, wherein said momentarily engaging a sheet includes moving a clamping member into engagement with the sheet to retard the sheet movement.

26. The method of claim 25, including the step of momentarily braking said conveyor during said engaging step.

* * * * *